US010816222B2

(12) United States Patent
Ooshita et al.

(10) Patent No.: US 10,816,222 B2
(45) Date of Patent: Oct. 27, 2020

(54) HOT WATER APPARATUS WITH FLANGED CONNECTIONS

(71) Applicant: NORITZ CORPORATION, Hyogo (JP)

(72) Inventors: Wataru Ooshita, Himeji (JP); Takeshi Oohigashi, Kakogawa (JP)

(73) Assignee: NORITZ CORPORATION, Hyogo (JP)

( * ) Notice: Subject to any disclaimer, the term of this patent is extended or adjusted under 35 U.S.C. 154(b) by 414 days.

(21) Appl. No.: 15/857,718

(22) Filed: Dec. 29, 2017

(65) Prior Publication Data

US 2018/0195742 A1 Jul. 12, 2018

(30) Foreign Application Priority Data

Jan. 11, 2017 (JP) ..... 2017-002621

(51) Int. Cl.

| | |
|---|---|
| ***F24D 19/00*** | (2006.01) |
| ***F24D 19/08*** | (2006.01) |
| ***F24H 9/12*** | (2006.01) |
| ***F24D 19/06*** | (2006.01) |

(52) U.S. Cl.

CPC ..... *F24D 19/088* (2013.01); *F24D 19/0004* (2013.01); *F24D 19/06* (2013.01); *F24H 9/124* (2013.01); *F24D 2220/0242* (2013.01); *F24D 2220/0271* (2013.01)

(58) Field of Classification Search

CPC .... F24D 19/088; F24D 19/0004; F24D 19/06; F24D 2220/0242; F24D 2220/0271; F24D 2220/06; F24D 3/00; F24D 3/08; F24D 17/0026; F24H 9/124; F24H 9/16; F24H 9/165; F24H 1/124; F24H 1/145; F24H 1/24; F24H 1/445; F24H 1/52; F24H 1/148; F24H 8/00; F24H 8/006

See application file for complete search history.

(56) References Cited

U.S. PATENT DOCUMENTS

| | | | | |
|---|---|---|---|---|
| 4,421,066 A * | 12/1983 | Gordbegli | F24H 1/40 | 122/264 |
| 4,444,156 A * | 4/1984 | Iwasaki | F24H 1/145 | 110/203 |
| 4,737,102 A * | 4/1988 | Jinno | F23C 5/02 | 122/18.4 |
| 2002/0166587 A1* | 11/2002 | Weaver | F24H 8/006 | 137/312 |

(Continued)

FOREIGN PATENT DOCUMENTS

WO 2015/141995 A1 9/2015

*Primary Examiner* — Travis C Ruby

(74) *Attorney, Agent, or Firm* — Studebaker & Brackett PC

(57) ABSTRACT

A hot water apparatus includes a heat exchanger and a housing. A case of the heat exchanger has a circumferential wall portion, a lower opening, and a flange portion. A case of the housing has a flange portion, a circumferential wall portion, and an upper opening. The circumferential wall portion includes a downwardly-extending wall portion inserted into the inside of the circumferential wall portion through the upper opening. In a state where the downwardly-extending wall portion is arranged inside the circumferential wall portion, the lower opening is located below an upper surface of the flange portion, and a flange connection is formed between the heat exchanger and the housing.

7 Claims, 9 Drawing Sheets

(56) References Cited

U.S. PATENT DOCUMENTS

| | | | | |
|---|---|---|---|---|
| 2008/0006226 | A1* | 1/2008 | Takeda | F24H 1/40 122/18.1 |
| 2010/0170452 | A1* | 7/2010 | Ford | F24H 9/2035 122/14.21 |
| 2010/0229804 | A1* | 9/2010 | Okamoto | F24H 1/523 122/18.2 |
| 2011/0155079 | A1* | 6/2011 | Matsunaga | F24H 1/43 122/15.1 |
| 2011/0174891 | A1* | 7/2011 | Kowald | B23P 15/26 237/53 |
| 2012/0272928 | A1* | 11/2012 | Kameyama | F24H 1/28 122/19.2 |
| 2013/0264037 | A1* | 10/2013 | Otsubo | F28D 7/087 165/157 |
| 2014/0174382 | A1* | 6/2014 | Oohigashi | F24F 1/24 122/18.4 |
| 2014/0190425 | A1* | 7/2014 | Oohigashi | F24H 8/006 122/18.4 |
| 2016/0010891 | A1* | 1/2016 | Wada | F24H 9/0026 122/18.4 |
| 2016/0025377 | A1* | 1/2016 | Matsunaga | F24H 1/145 122/18.4 |
| 2016/0116228 | A1* | 4/2016 | Huang | F24H 1/145 122/18.2 |
| 2016/0341424 | A1* | 11/2016 | Kashihara | F23M 11/00 |
| 2017/0059205 | A1 | 3/2017 | Kim | |

* cited by examiner (COMPARATIVE EXAMPLE)

HOT WATER APPARATUS WITH FLANGED CONNECTIONS

BACKGROUND OF THE INVENTION

Field of the Invention

The present invention relates to a hot water apparatus.

Description of the Background Art

A hot water apparatus including a heat exchanger for exchanging heat between heating gas and water and/or hot water is disclosed in International Publication WO2015/141995, for example. The hot water apparatus disclosed in this literature includes a sensible heat recovery heat exchanger and a latent heat recovery heat exchanger. The sensible heat recovery heat exchanger and the latent heat recovery heat exchanger have cases that communicate with each other. The case of the sensible heat recovery heat exchanger has a lower end provided with a first flange portion, and the case of the latent heat recovery heat exchanger has an upper end provided with a second flange portion. The first flange portion and the second flange portion are connected to each other.

In the hot water apparatus disclosed in the above-described literature, drainage water produced inside the sensible heat recovery heat exchanger flows downward along the inner surface of the case of the sensible heat recovery heat exchanger. When this drainage water flows to the lower end of the case of the sensible heat recovery heat exchanger, this drainage water may flow out through between the first flange portion of the sensible heat recovery heat exchanger and the second flange portion of the latent heat recovery heat exchanger.

SUMMARY OF THE INVENTION

The present invention has been made in light of the above-described problems. An object of the present invention is to provide a hot water apparatus capable of suppressing drainage water produced inside a heat exchanger from flowing out through between a first flange portion of a heat exchanger and a second flange portion connected to the first flange portion.

A hot water apparatus of the present invention includes a heat exchanger and a housing. The heat exchanger includes a heat exchange portion and a first case in which the heat exchange portion is housed. The housing includes a second case connected to the first case of the heat exchanger. The first case of the heat exchanger includes a first circumferential wall portion, a first opening provided at a lower end of the first circumferential wall portion, and a first flange portion located above the first opening and extending outward from the first circumferential wall portion. The second case of the housing includes a second flange portion connected to the first flange portion, a second circumferential wall portion arranged inside the second flange portion, and a second opening provided at an upper end of the second circumferential wall portion. The first circumferential wall portion of the heat exchanger includes a downwardly-extending wall portion inserted through the second opening of the housing into an inside of the second circumferential wall portion. In a state where the downwardly-extending wall portion is arranged inside the second circumferential wall portion, the first opening is located below an upper surface of the second flange portion.

According to the hot water apparatus of the present invention, in the state where the downwardly-extending wall portion is arranged inside the second circumferential wall portion, the first opening is located below an upper surface of the second flange portion. Accordingly, the drainage water produced inside the heat exchanger flows along the downwardly-extending wall portion downward from the first opening. Thus, the drainage water can be suppressed from flowing through the first opening onto the upper surface of the second flange portion. Thereby, the drainage water produced inside the heat exchanger can be suppressed from flowing out through between the first flange portion and the second flange portion.

In the above-described hot water apparatus, the first opening is located below a lower surface of the second flange portion. Accordingly, the distance from the first opening to the upper surface of the second flange portion in the vertical direction is greater than the distance from the upper surface of the second flange portion to the lower surface thereof in the vertical direction. Thus, the drainage water produced inside the heat exchanger can be effectively suppressed from flowing through the first opening onto the upper surface of the second flange portion.

In the above-described hot water apparatus, the downwardly-extending wall portion is provided on an entire circumference of the first circumferential wall portion. Thus, the drainage water produced inside the heat exchanger can be suppressed from flowing through the first opening onto the upper surface of the second flange portion in the entire circumference of the first circumferential wall portion.

In the above-described hot water apparatus, the first circumferential wall portion includes a plate member. The downwardly-extending wall portion is formed by folding the plate member at the lower end of the first circumferential wall portion. Accordingly, the drainage water produced inside the heat exchanger can be prevented from flowing from the lower end of the first circumferential wall portion into the inside of the downwardly-extending wall portion. Thus, the downwardly-extending wall portion can be prevented from corroding from its inside due to the drainage water.

In the above-described hot water apparatus, the downwardly-extending wall portion is arranged such that a gap is interposed between the downwardly-extending wall portion and the second circumferential wall portion. Accordingly, the drainage water produced inside the heat exchanger can be suppressed from flowing, due to surface tension, from the first opening through between the downwardly-extending wall portion and the second circumferential wall portion onto the upper surface of the second flange portion.

In the above-described hot water apparatus, the housing includes a connection portion connected to a lower end of the second circumferential wall portion. The connection portion extends toward an inside of the second circumferential wall portion, and is arranged such that a gap is interposed between the connection portion and a lower end of the downwardly-extending wall portion. The gap between the downwardly-extending wall portion and the second circumferential wall portion is greater than the gap between the downwardly-extending wall portion and the connection portion. Accordingly, the drainage water produced inside the heat exchanger is likely to flow more into the gap between the downwardly-extending wall portion and the connection portion than into the gap between the downwardly-extending wall portion and the second circumferential wall portion. Thus, the drainage water can be suppressed from flowing through between the downwardly-extending wall portion and the second circumferential wall portion. Thereby, the drainage water produced inside the heat exchanger can be suppressed from flowing through between the downwardly-extending wall portion and the second circumferential wall portion onto the upper surface of the second flange portion.

In the above-described hot water apparatus, the housing includes a connection portion connected to a lower end of the second circumferential wall portion. The connection portion is inclined so as to be downwardly sloped toward the inside of the second circumferential wall portion, and is arranged such that a gap is interposed between the connection portion and a lower end of the downwardly-extending wall portion. Accordingly, the drainage water produced inside the heat exchanger flows along the connection portion toward the inside of the second circumferential wall portion. Thus, the drainage water can be suppressed from flowing toward the second flange portion. Thereby, the drainage water produced inside the heat exchanger can be suppressed from flowing onto the upper surface of the second flange portion.

In the above-described hot water apparatus, the housing includes a rising coupling portion arranged inside the connection portion and rising upward from the connection portion, a through hole surrounded by the rising coupling portion, and a main body portion inserted into the through hole. The rising coupling portion is joined from outside to an upper end of the main body portion. Accordingly, the rising coupling portion can be readily welded to the upper end of the main body portion.

In the above-described hot water apparatus, the rising coupling portion includes a first cutout portion provided at an upper end of the rising coupling portion. The main body portion includes a second cutout portion provided at the upper end of the main body portion. The first cutout portion is arranged so as to overlap with the second cutout portion. Accordingly, the drainage water can be caused to flow from the first cutout portion and the second cutout portion into the through hole. Thereby, the drainage water can be readily discharged.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be hereinafter described with reference to the accompanying drawings.

First Embodiment

First, the configuration of a hot water apparatus in the first embodiment of the present invention will be hereinafter described with reference to FIG. 1.

Figure 1:
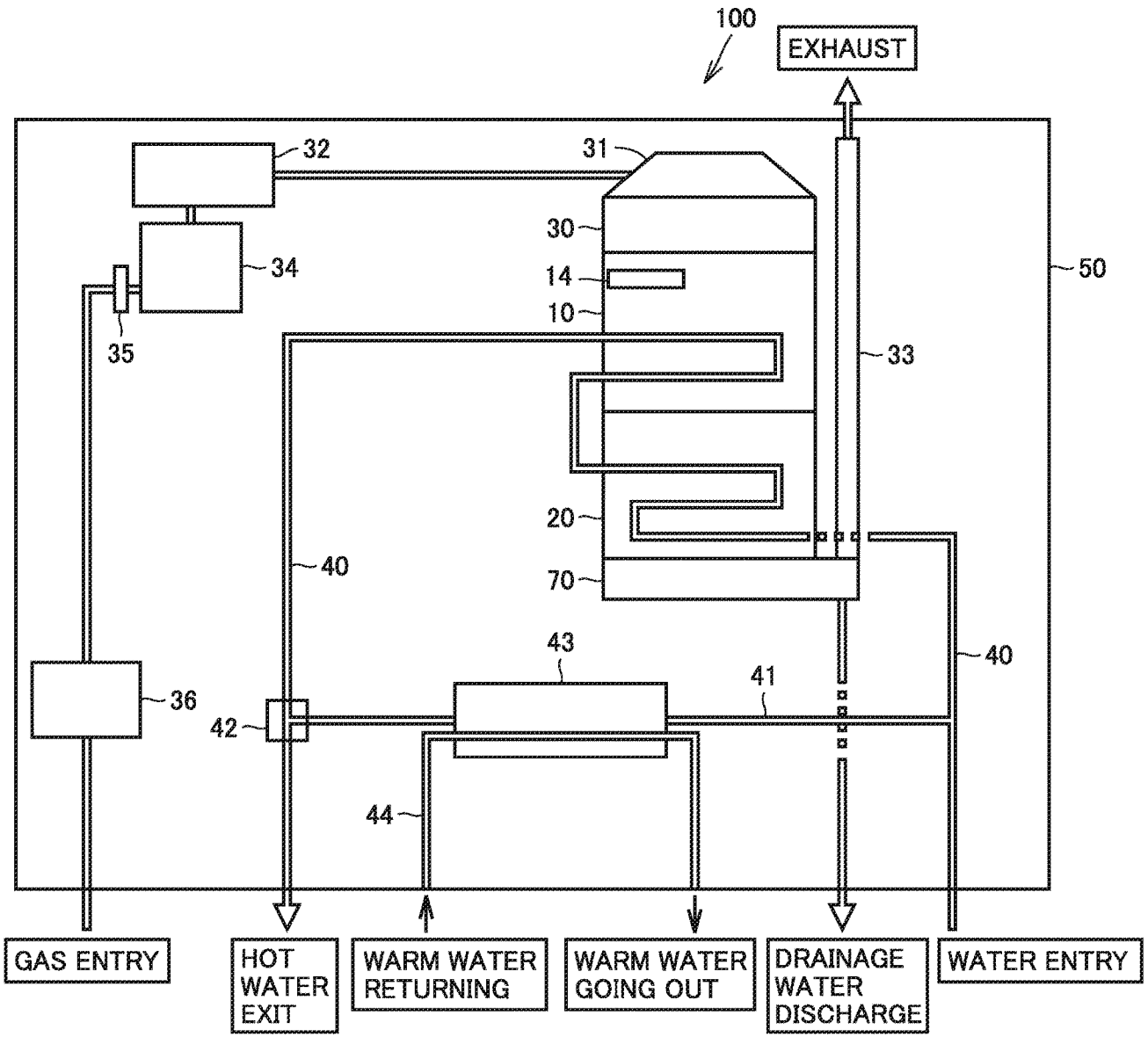
FIG. 1 is a diagram schematically showing the configuration of a hot water apparatus in the first embodiment of the present invention.

As shown in FIG. 1, a hot water apparatus 100 of the present embodiment mainly includes a sensible heat recovery heat exchanger (primary heat exchanger) 10, an ignition plug 14, a latent heat recovery heat exchanger (secondary heat exchanger) 20, a burner 30, a chamber 31, a fan assembly 32, a duct 33, a venturi 34, an orifice 35, a gas valve 36, a pipe 40, a bypass pipe 41, a three-way valve 42, a liquid to liquid heat exchanger 43, a hydronic pipe 44, a housing 50, and an exhaust collection and guide member 70. All of components except for housing 50 among the above-mentioned components are arranged inside housing 50.

Fuel gas flows through gas valve 36 and orifice 35 into venturi 34. The mixed gas mixed in venturi 34 is fed to fan assembly 32. Fan assembly 32 serves to supply the mixed gas to burner 30.

Fan assembly 32 is connected to chamber 31 that is connected to burner 30. The mixed gas supplied from fan assembly 32 is fed to burner 30 through chamber 31.

Burner 30 serves to produce heating gas to be supplied to sensible heat recovery heat exchanger (heat exchanger) 10. The mixed gas blown out of burner 30 is ignited by ignition plug 14 and turned into combustion gas.

Burner 30, sensible heat recovery heat exchanger 10 and latent heat recovery heat exchanger 20 are connected such that combustion gas flows sequentially through sensible heat recovery heat exchanger 10 and latent heat recovery heat exchanger 20 so as to be heat-exchanged with water and/or hot water. Exhaust collection and guide member 70 is connected to latent heat recovery heat exchanger 20. To exhaust collection and guide member 70, duct 33 is connected, which extends to the outside of housing 50. Thereby, combustion gas having passed through latent heat recovery heat exchanger 20 is caused to flow through exhaust collection and guide member 70 and discharged through duct 33 to the outside of housing 50.

A portion of pipe 40 on the hot water exit side relative to sensible heat recovery heat exchanger 10 is connected to bypass pipe 41 by three-way valve 42. Liquid to liquid heat exchanger 43 is connected to bypass pipe 41. The warm water flowing through the inside of liquid to liquid heat exchanger 43 flows on the outside of warm water pipe 44, thereby allowing heat exchange between the warm water flowing through liquid to liquid heat exchanger 43 and the warm water flowing through warm water pipe 44.

Figure 2:
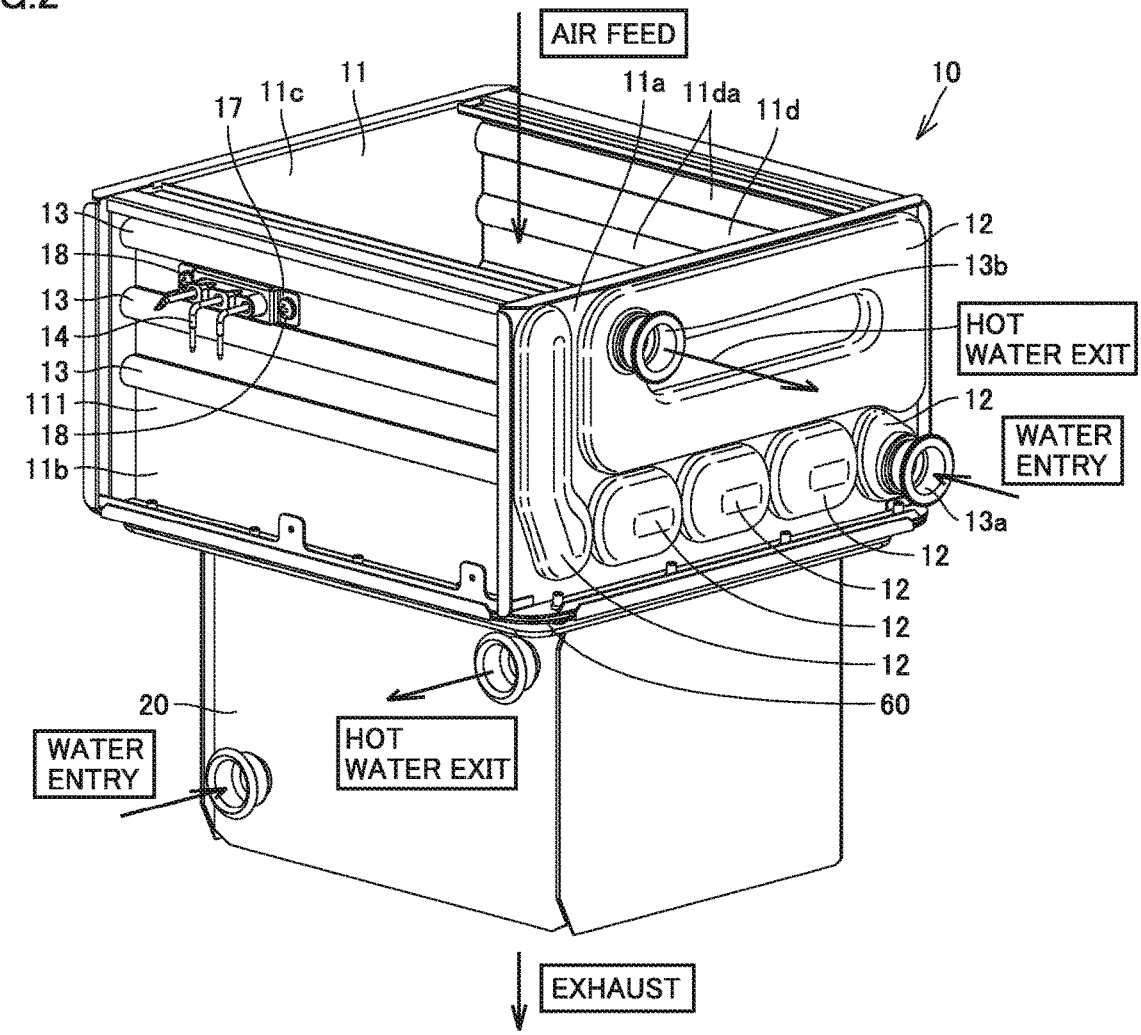
FIG. 2 is a perspective view schematically showing the configurations of a sensible heat recovery heat exchanger and a latent heat recovery heat exchanger in the first embodiment of the present invention.

Then, the configuration of a heat exchanger set of the present embodiment will be hereinafter described with reference to FIGS. 2 to 8. As shown in FIG. 2, the heat exchanger set includes sensible heat recovery heat exchanger (heat exchanger) 10, latent heat recovery heat exchanger (housing) 20, and a sealing member 60. In the present embodiment, sensible heat recovery heat exchanger 10 corresponds to a heat exchanger in the claims, and latent heat recovery heat exchanger 20 corresponds to a housing in the claims.

Figure 3:
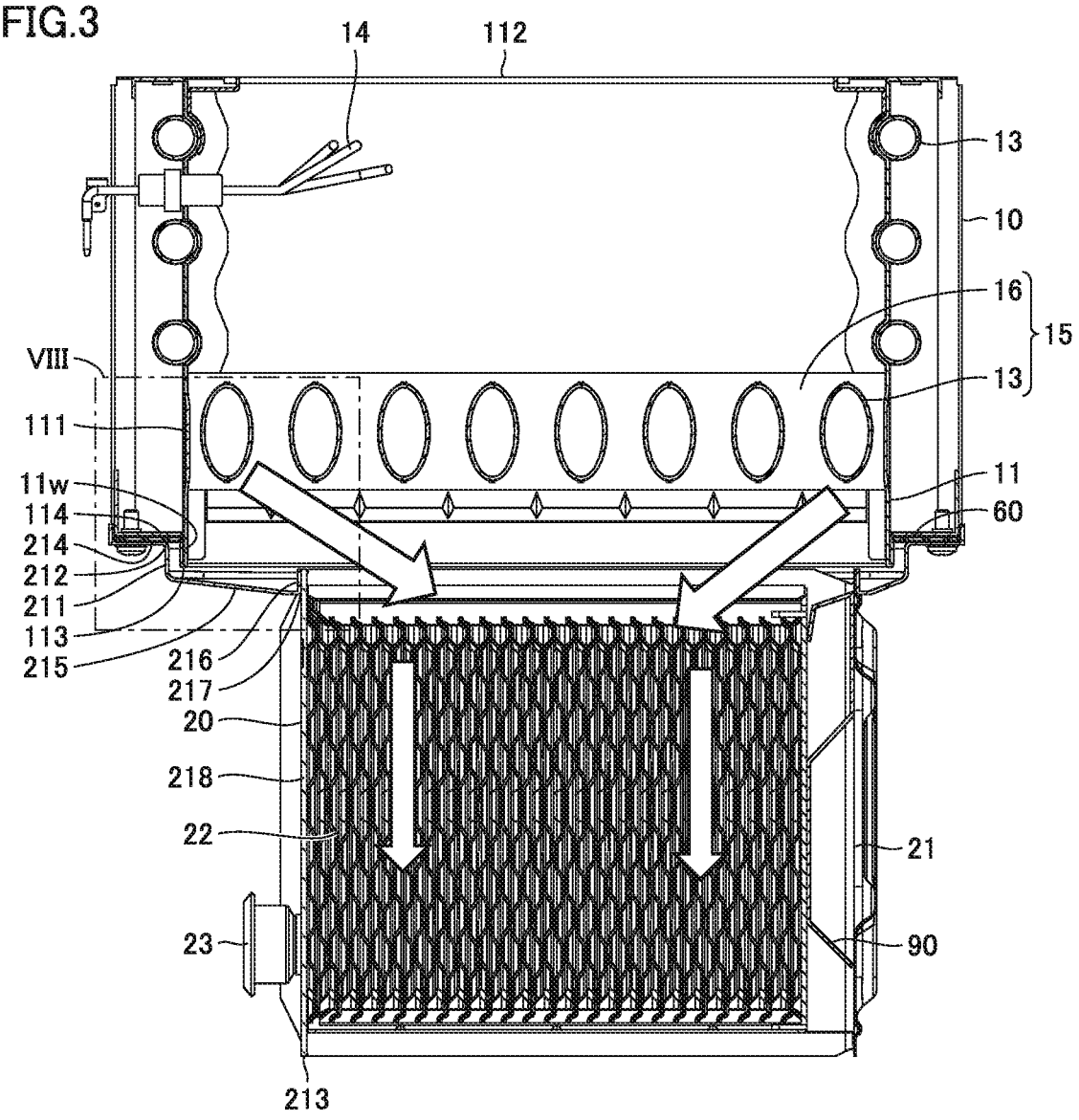
FIG. 3 is a cross-sectional view schematically showing the configurations of the sensible heat recovery heat exchanger and the latent heat recovery heat exchanger in the first embodiment of the present invention.
Figure 4:
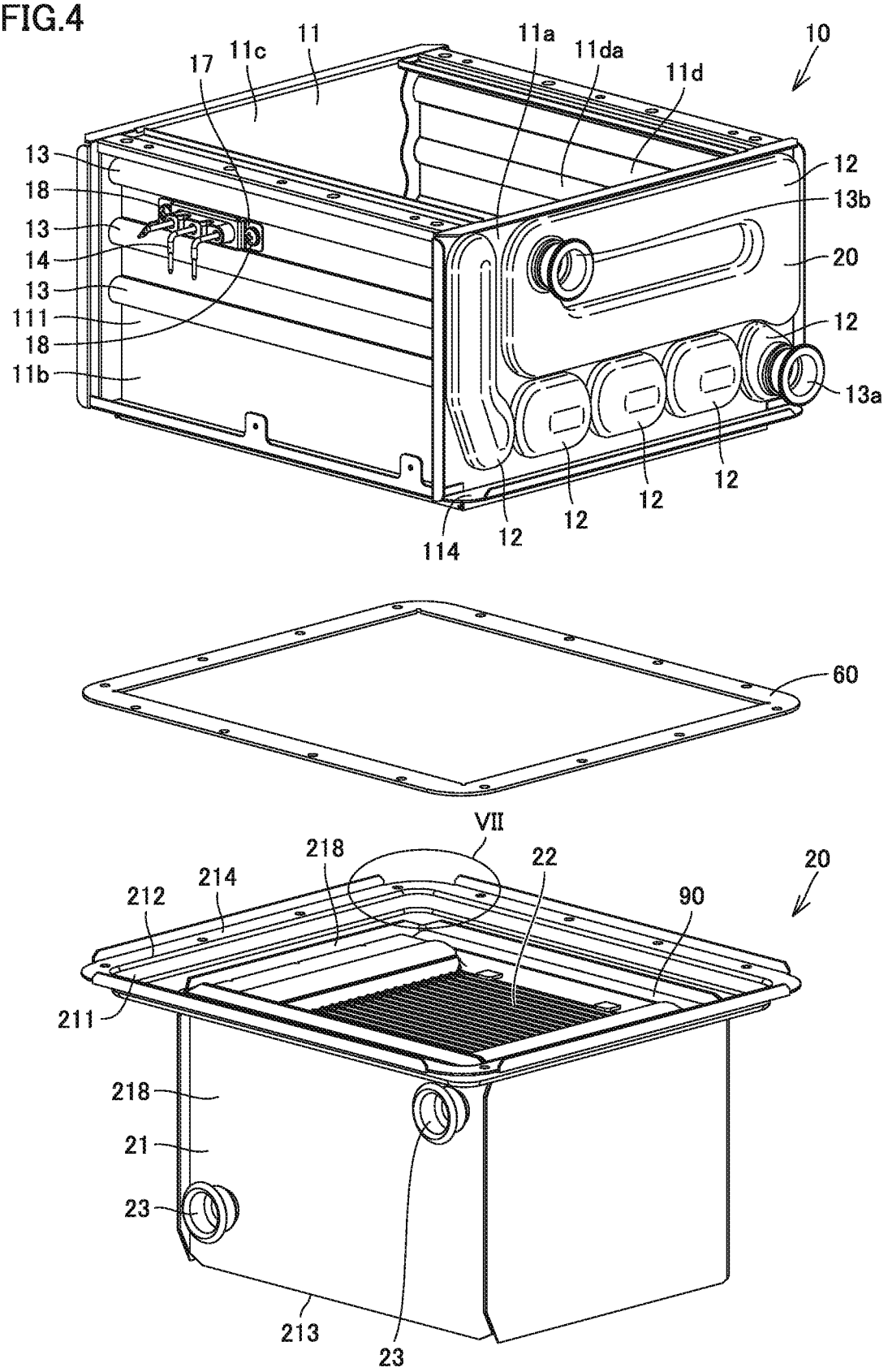
FIG. 4 is an exploded perspective view schematically showing the configurations of the sensible heat recovery heat exchanger and the latent heat recovery heat exchanger in the first embodiment of the present invention.

As shown in FIGS. 3 and 4, sensible heat recovery heat exchanger 10 is arranged on latent heat recovery heat exchanger 20 with sealing member 60 interposed therebetween. In other words, sealing member 60 is sandwiched between sensible heat recovery heat exchanger 10 and latent heat recovery heat exchanger 20. Sealing member 60 is formed in an annular shape. Also, sealing member 60 is formed in a plate shape. In addition, sealing member 60 does not have to be arranged between sensible heat recovery heat exchanger 10 and latent heat recovery heat exchanger 20.

As shown in FIGS. 2 and 3, sensible heat recovery heat exchanger 10 of the present embodiment mainly includes a case (first case) 11, a header 12, a heat transfer tube (heat absorption pipe) 13, a fin 16, a pressing member 17, and a fixing member 18. Heat transfer tube (heat absorption pipe) 13 and fin 16 that are arranged inside case 11 constitute a heat exchange portion 15.

Case 11 houses heat exchange portion 15. Case 11 has a circumferential wall portion (first circumferential wall portion) 111, an upper opening 112, a lower opening (first opening) 113, and a flange portion (first flange portion) 114. Case 11 has a first sidewall 11*a*, a second sidewall 11*b*, a third sidewall 11*c*, and a fourth sidewall 11*d*. First sidewall 11*a* to fourth sidewall 11*d* are connected to one another so as to form a rectangular frame shape. First sidewall 11*a* to fourth sidewall 11*d* constitute circumferential wall portion 111.

Case 11 having the above-described frame shape has upper opening 112 and lower opening 113. This allows combustion gas to be supplied to the inside of case 11 through upper opening 112 of case 11. This also allows combustion gas to be emitted through lower opening 113 of case 11 to the outside of case 11.

Header 12 is provided on the outer surface of first sidewall 11*a*. Header 12 provided on the outer surface of first sidewall 11*a* is provided with a joint 13*a* on the water entry side and a joint 13*b* on the hot water exit side. Header 12 (not shown) is provided also on the outer surface of third sidewall 11*c*.

Header 12 provided on the outer surface of first sidewall 11*a* and header 12 provided on the outer surface of third sidewall 11*c* are connected to each other through a plurality of heat transfer tubes 13. The plurality of heat transfer tubes 13 include heat transfer tubes 13 located inside case 11 and heat transfer tubes 13 located outside case 11.

Water and/or hot water flowing through header 12 and heat transfer tube 13 is, for example, as described below.

Water and/or hot water introduced through joint 13*a* on the water entry side flows into heat transfer tube 13 located inside case 11 through header 12 provided on the side closest to one end of the outer surface of first sidewall 11*a*. Water and/or hot water having flown into heat transfer tube 13 reaches header 12 (not shown) provided on the outer surface of third sidewall 11*c*. Water and/or hot water that reaches header 12 provided on the outer surface of third sidewall 11*c* flows through another heat transfer tube 13 connected to this header 12 and reaches a header 12 provided on the outer surface of first sidewall 11*a*. Thus, water and/or hot water flows from the side of first sidewall 11*a* toward third sidewall 11*c* and thereafter turns back from the side of third sidewall 11*c* toward first sidewall 11*a*. Then, water and/or hot water flows while repeating turning back toward third sidewall 11*c* and turning back toward first sidewall 11*a*.

Water and/or hot water that reaches header 12 provided on the side closest to the other end of the outer surface of first sidewall 11*a* as described above reaches header 12 provided on the outer surface of third sidewall 11*c* through heat transfer tube 13 provided on the outer surface of second sidewall 11*b*. Water and/or hot water that reaches header 12 provided on the outer surface of third sidewall 11*c* flows through heat transfer tube 13 provided on the outer surface of fourth sidewall 11*d* and reaches header 12 provided on the outer surface of first sidewall 11*a*. Finally, water and/or hot water exits from joint 13*b* on the hot water exit side.

As shown in FIGS. 3 and 4, flange portion 114 is located above lower opening 113 and extends outward from circumferential wall portion 111. Circumferential wall portion 111 has a downwardly-extending wall portion 11*w* arranged at the lower end of circumferential wall portion 111. Downwardly-extending wall portion 11*w* is arranged below flange portion 114. Downwardly-extending wall portion 11*w* has a lower end provided with lower opening 113.

Figure 5:
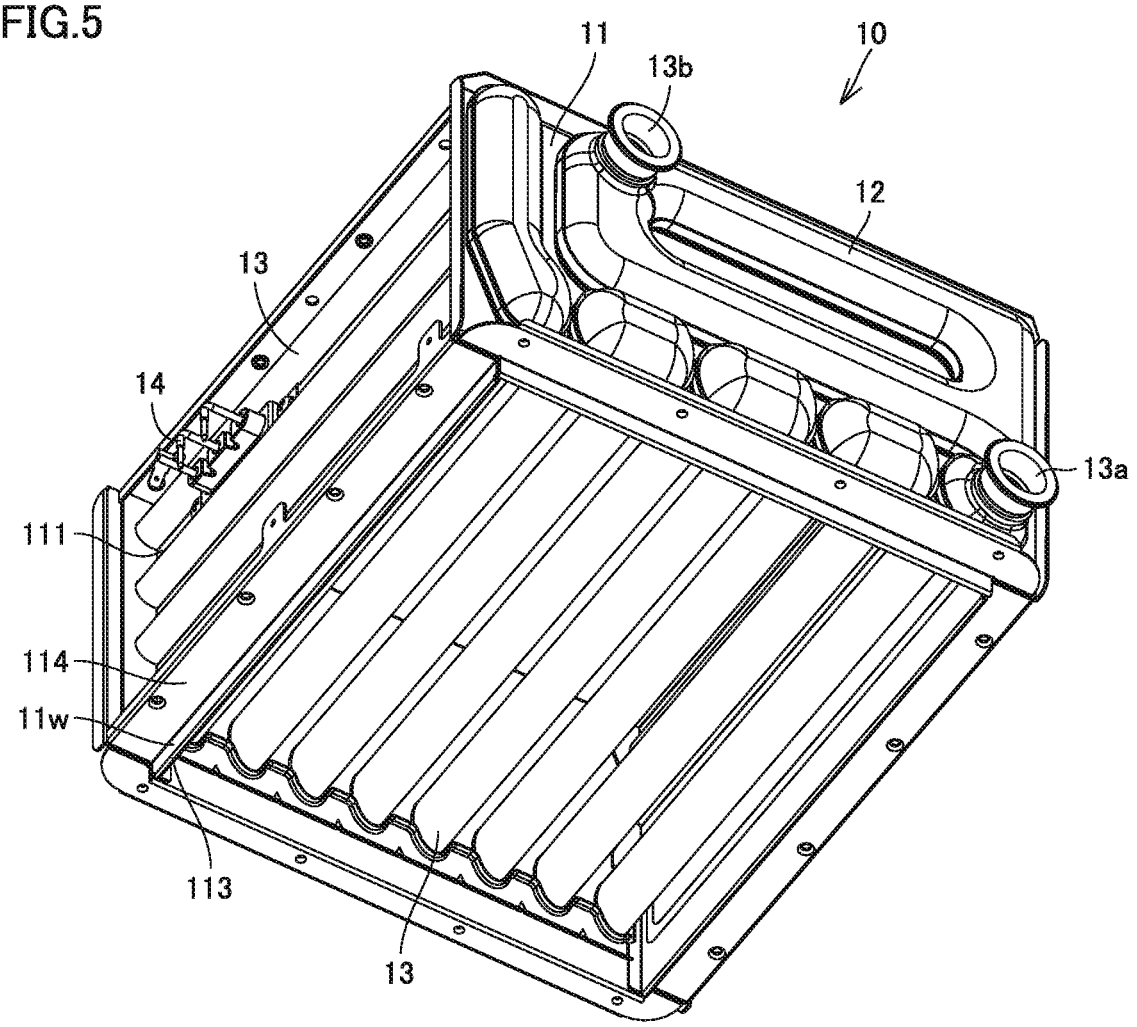
FIG. 5 is a perspective view schematically showing the configuration of the sensible heat recovery heat exchanger in the first embodiment of the present invention.

As shown in FIG. 5, flange portion 114 is provided around the entire circumference of circumferential wall portion 111. Downwardly-extending wall portion 11*w* is provided on the entire circumference of circumferential wall portion 111. Downwardly-extending wall portion 11*w* is configured to have a rectangular frame shape.

As shown in FIGS. 3 and 5, a plurality of fins 16 are connected to the outer circumferential surface of heat transfer tube 13 located inside case 11. It is to be noted that FIG. 5 does not show fins for the sake of simplification of the description.

Referring to FIGS. 3 and 4, latent heat recovery heat exchanger 20 mainly includes a case (second case) 21, a heat exchange portion 22, and a joint portion 23. Case 21 is connected to case 11.

Case 21 has a circumferential wall portion (second circumferential wall portion) 211, an upper opening (second opening) 212, a lower opening 213, a flange portion (second flange portion) 214, a connection portion 215, a rising coupling portion 216, a through hole 217, and a main body portion 218.

Case 21 houses heat exchange portion 22. Circumferential wall portion 211 of case 21 is configured to surround the circumference of downwardly-extending wall portion 11*w*. Circumferential wall portion 211 is configured to have a rectangular frame shape. Case 21 having the above-described frame shape has upper opening 212 and lower opening 213. This allows combustion gas to be supplied to the inside of case 21 through upper opening 212 of case 21. This also allows combustion gas to be emitted to the outside of case 21 through lower opening 213 of case 21.

Heat exchange portion 22 is to perform heat exchange between heating gas flowing outside heat exchange portion 22 and water and/or hot water flowing inside heat exchange portion 22. Heat exchange portion 22 has a plurality of heat transfer plates. The plurality of heat transfer plates are stacked on one another. The heat transfer plates adjacent to each other among the plurality of heat transfer plates are brazed to each other. A gap between a pair of adjacent heat transfer plates of the plurality of heat transfer plates defines a flow path through which water and/or hot water flows. A space between a pair of adjacent heat transfer plates of the plurality of heat transfer plates defines a flow path through which combustion gas flows.

A pair of joint portions 23 serves to cause water and/or hot water to flow therethrough into and out of the plurality of heat transfer plates in heat exchange portion 22. The pair of joint portions 23 each serves as a joint for connecting pipes. The pair of joint portions 23 each has a flow path that is connected to an internal flow path in each of the plurality of heat transfer plates. Therefore, water and/or hot water introduced from joint portion 23 on the water entry side flows through the internal flow path in each of the pair of heat transfer plates, and thereafter, exits from joint portion 23 on the hot water exit side.

Figure 6:
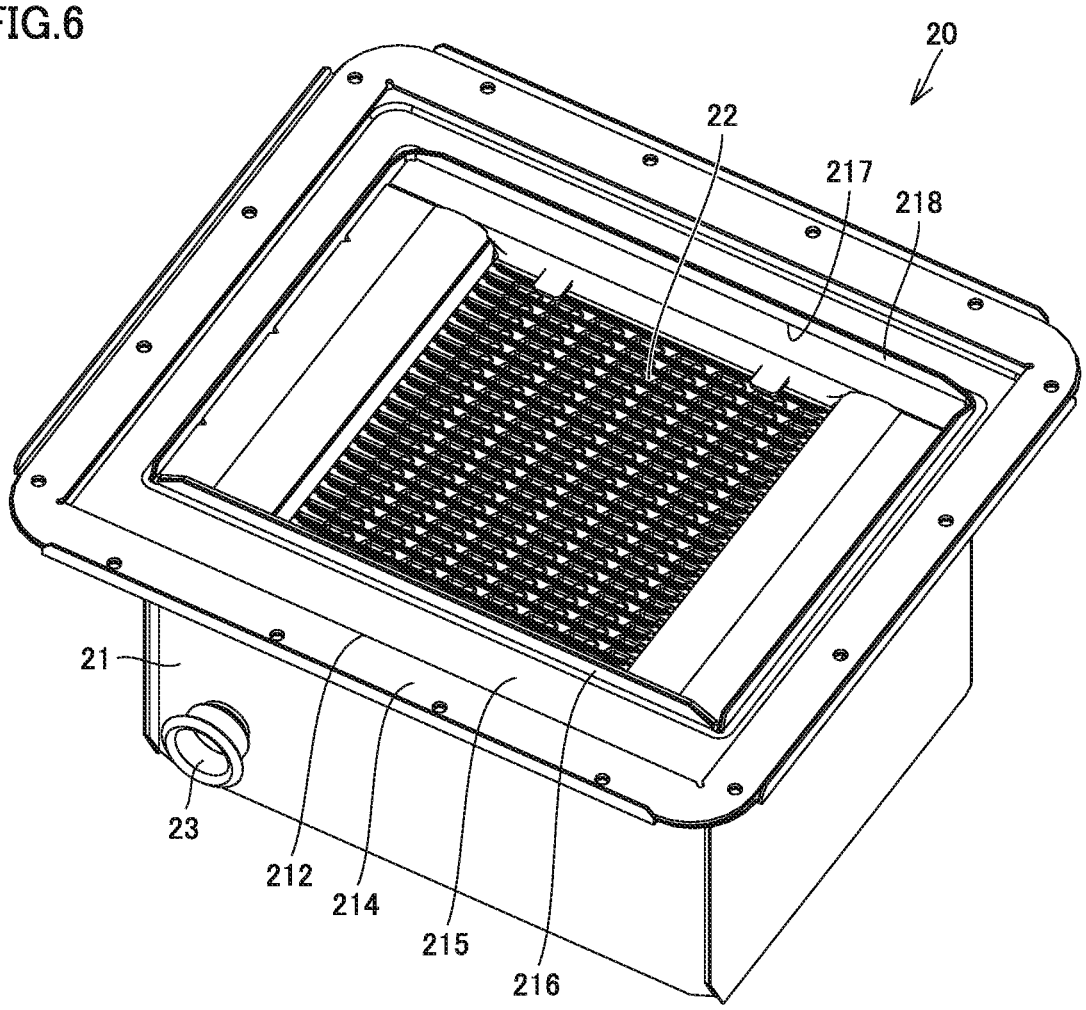
FIG. 6 is a perspective view schematically showing the configuration of the latent heat recovery heat exchanger in the first embodiment of the present invention.

As shown in FIGS. 4 and 6, flange portion 214 is arranged at the upper end of case 21. Flange portion 214 is formed in an annular shape. Flange portion 214 extends from circumferential wall portion 211 to the outside of case 21. Flange portion 214 is connected to the upper end of circumferential wall portion 211. Circumferential wall portion 211 is arranged inside flange portion 214. Upper opening 212 is provided at the upper end of circumferential wall portion 211. Upper opening 212 is provided inside circumferential wall portion 211. Sealing member 60 is placed on flange portion 214.

Rising coupling portion 216 is arranged inside connection portion 215. Rising coupling portion 216 rises upward from connection portion 215. Through hole 217 is surrounded by rising coupling portion 216. Main body portion 218 is inserted into through hole 217. Main body portion 218 is configured to surround the circumference of heat exchange portion 22. Rising coupling portion 216 is joined from outside to the upper end of main body portion 218 inserted into through hole 217.

Figure 7:
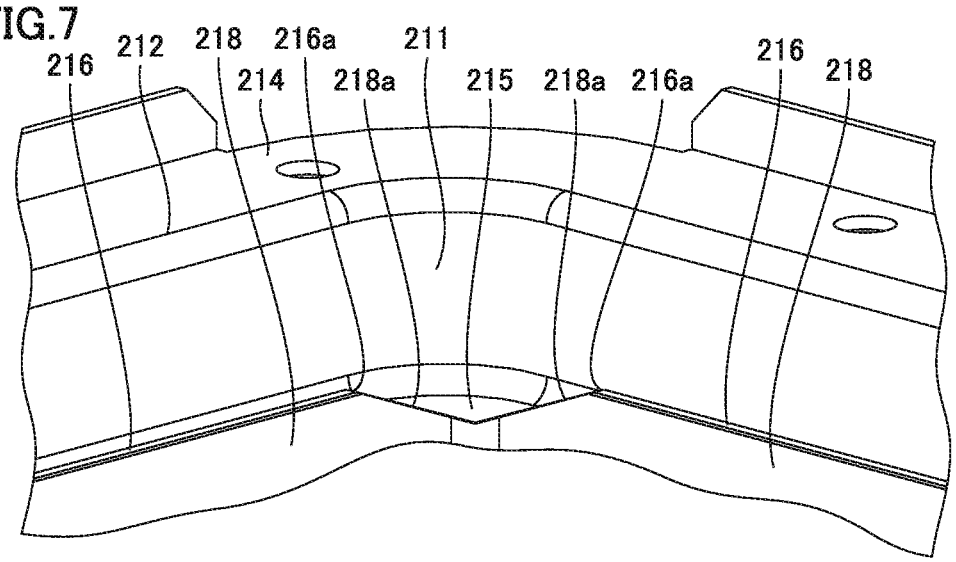
FIG. 7 is an enlarged view of a portion VII in FIG. 4.

As shown in FIG. 7, a first cutout portion 216*a* is provided at the upper end of rising coupling portion 216. Accordingly, rising coupling portion 216 is low in height in first cutout portion 216*a*. A second cutout portion 218*a* is provided at the upper end of main body portion 218. Accordingly, the upper end of main body portion 218 is low in height in second cutout portion 218*a*.

In the state where the upper end of main body portion 218 is inserted into through hole 217, first cutout portion 216*a* is arranged so as to overlap with second cutout portion 218*a*. Namely, first cutout portion 216*a* and second cutout portion 218*a* are arranged so as to communicate with each other.

Through hole 217 is formed in a rectangular shape when flange portion 214 is seen from above. First cutout portion 216*a* and second cutout portion 218*a* are provided at each of four corners of through hole 217.

Figure 8:
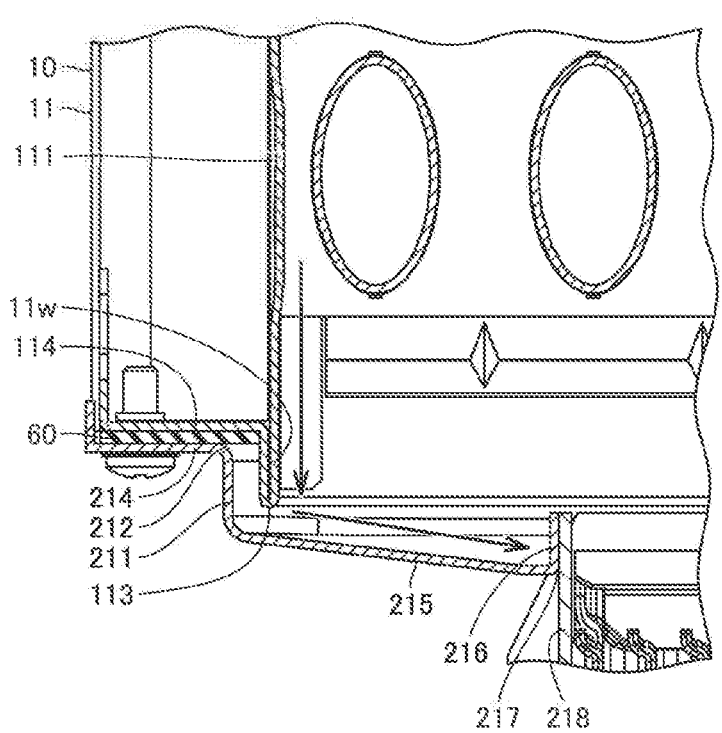
FIG. 8 is an enlarged view of a portion VIII in FIG. 3.

As shown in FIGS. 3 and 8, flange portion 214 of case 21 in latent heat recovery heat exchanger 20 is connected to flange portion 114 of case 11 in sensible heat recovery heat exchanger 10. Downwardly-extending wall portion 11*w* of case 11 is inserted through upper opening 212 of case 21 into the inside of circumferential wall portion 211. In the state where downwardly-extending wall portion 11*w* of case 11 is arranged inside circumferential wall portion 211 of case 21, lower opening 113 of case 11 is located below the upper surface of flange portion 214 of case 21. In the present embodiment, lower opening 113 of case 11 is located below the lower surface of flange portion 214 of case 21.

Circumferential wall portion 111 of case 11 includes a plate member. Downwardly-extending wall portion 11*w* of circumferential wall portion 111 is formed by folding the plate member at the lower end of circumferential wall portion 111. In other words, downwardly-extending wall portion 11*w* is formed by folding one plate member. Also, in the present embodiment, flange portion 114 is formed by bending one plate member. In other words, in each of first sidewall 11*a* to fourth sidewall 11*d* of case 11, circumferential wall portion 111, downwardly-extending wall portion 11*w* and flange portion 114 are formed of one plate member.

Downwardly-extending wall portion 11*w* of case 11 is arranged such that a gap is interposed between this downwardly-extending wall portion 11*w* of case 11 and circumferential wall portion 211 of case 21. In other words, downwardly-extending wall portion 11*w* is not in close contact with circumferential wall portion 211. A gap between downwardly-extending wall portion 11*w* and circumferential wall portion 211 is provided on the outside of circumferential wall portion 111. In the present embodiment, the gap between downwardly-extending wall portion 11*w* and circumferential wall portion 211 is provided around the entire circumference of circumferential wall portion 111.

Connection portion 215 of case 21 is connected to the lower end of circumferential wall portion 211. Connection portion 215 extends toward the inside of circumferential wall portion 211. Connection portion 215 is arranged such that a gap is interposed between this connection portion 215 and the lower end of downwardly-extending wall portion 11*w*. The gap between connection portion 215 and the lower end of downwardly-extending wall portion 11*w* is provided directly below the lower end of downwardly-extending wall portion 11*w*. The gap between downwardly-extending wall portion 11*w* and circumferential wall portion 211 is greater than the gap between downwardly-extending wall portion 11*w* and connection portion 215. In the present embodiment, connection portion 215 is inclined so as to be downwardly sloped toward the inside of circumferential wall portion 211.

As shown in FIGS. 2 and 3, in sensible heat recovery heat exchanger 10, when the temperature of the water and/or hot water introduced into heat transfer tube 13 is relatively low, or when an amount of heating by burner 30 is relatively small, drainage water is produced. This drainage water flows from sensible heat recovery heat exchanger 10 into latent heat recovery heat exchanger 20.

As shown in FIGS. 3 and 8, the drainage water flowing from sensible heat recovery heat exchanger 10 into latent heat recovery heat exchanger 20 flows into heat exchange portion 22. Specifically, as shown by arrows in FIGS. 3 and 8, drainage water produced in sensible heat recovery heat exchanger 10 flows along the inner surface of circumferential wall portion 111 of case 11 and drops from lower opening 113 onto connection portion 215 of case 21. This drainage water flows along the slope of connection portion 215 on the upper surface of connection portion 215 obliquely downward to the inside of circumferential wall portion 211. When drainage water reaches rising coupling portion 216, this drainage water flows into heat exchange portion 22 through first cutout portion 216*a* and second cutout portion 218*a*. The drainage water having flown into heat exchange portion 22 passes through heat exchange portion 22 and flows out from lower opening 213.

Then, the functions and effects of the present embodiment will be hereinafter described in comparison with a comparative example.

Since the comparative example has the same configuration as that of the above-described present embodiment unless otherwise specified, the same components are designated by the same reference characters, and the description thereof will not be repeated.

Figure 9:
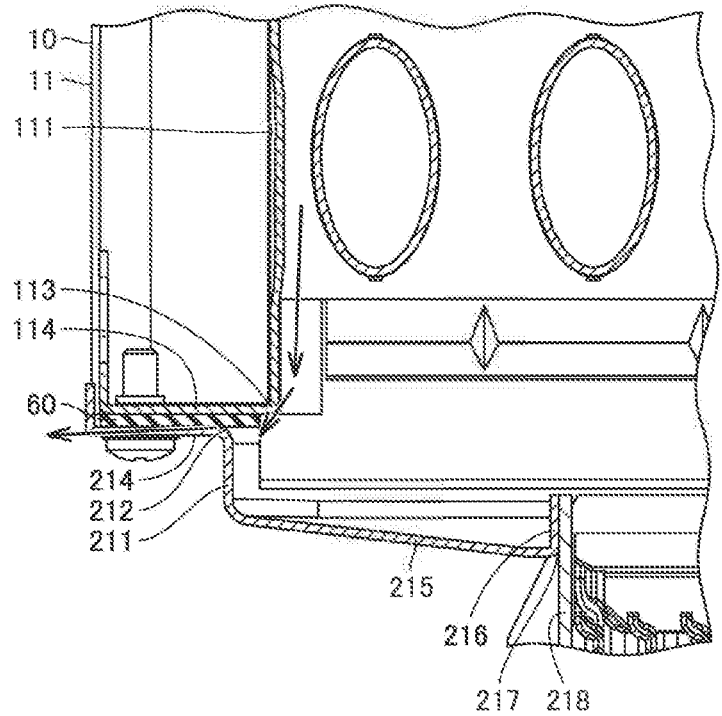
FIG. 9 is a cross-sectional view showing a portion corresponding to FIG. 8 in a comparative example.

The comparative example will be hereinafter described with reference to FIG. 9. In the comparative example, the downwardly-extending wall portion of the present embodiment is not provided. Thus, as shown by an arrow in FIG. 9, drainage water produced inside sensible heat recovery heat exchange 10 flows downward along the inner surface of circumferential wall portion 111 of case 11. When this drainage water flows to the lower end of circumferential wall portion 111, the drainage water may flow into between flange portion 114 of sensible heat recovery heat exchanger 10 and flange portion 214 of latent heat recovery heat exchanger 20. Consequently, the drainage water may pass through between flange portion 114 of sensible heat recovery heat exchanger 10 and flange portion 214 of latent heat recovery heat exchanger 20, and flow out from sensible heat recovery heat exchanger 10 and latent heat recovery heat exchanger 20.

On the other hand, according to hot water apparatus 100 of the present embodiment, as shown in FIG. 8, in the state where downwardly-extending wall portion 11*w* is arranged on the inside of circumferential wall portion (first circumferential wall portion) 211, lower opening (first opening) 113 is located below the upper surface of flange portion (second flange portion) 214. Accordingly, drainage water produced inside sensible heat recovery heat exchanger 10 moves along the inner surface of downwardly-extending wall portion 11*w* and flows downward from lower opening (first opening) 113. Thus, the drainage water can be suppressed from flowing onto the upper surface of flange portion (second flange portion) 214 located above lower opening (first opening) 113. Thereby, the drainage water produced inside sensible heat recovery heat exchanger 10 can be suppressed from flowing out through between the lower surface of flange portion (first flange portion) 114 and the upper surface of flange portion (second flange portion) 214.

Furthermore, lower opening (first opening) 113 is located below the lower surface of flange portion (second flange portion) 214. Accordingly, the distance from lower opening (first opening) 113 to the upper surface of flange portion (second flange portion) 214 in the vertical direction is greater than the distance from the upper surface of flange portion (second flange portion) 214 to the lower surface thereof in the vertical direction. Thus, the drainage water produced inside sensible heat recovery heat exchanger 10 can be effectively suppressed from flowing through lower opening (first opening) 113 onto the upper surface of flange portion (second flange portion) 214.

Furthermore, as shown in FIG. 5, downwardly-extending wall portion 11*w* is provided around the entire circumference of circumferential wall portion (first circumferential wall portion) 111. Thus, drainage water produced inside sensible heat recovery heat exchanger 10 can be suppressed from flowing through lower opening (first opening) 113 onto the upper surface of flange portion (second flange portion) 214 in the entire circumference of circumferential wall portion (first circumferential wall portion) 111.

Also as shown in FIG. 8, downwardly-extending wall portion 11*w* is configured by folding a plate member at the lower end of circumferential wall portion (first circumferential wall portion) 111. Thus, the drainage water produced inside sensible heat recovery heat exchanger 10 can be prevented from flowing into the inside of downwardly-extending wall portion 11*w* from the lower end of circumferential wall portion (first circumferential wall portion) 111. Accordingly, downwardly-extending wall portion 11*w* can be prevented from corroding from its inside due to drainage water.

Furthermore, downwardly-extending wall portion 11*w* is arranged such that a gap is interposed between downwardly-extending wall portion 11*w* and circumferential wall portion (second circumferential wall portion) 211. Accordingly, drainage water produced inside sensible heat recovery heat exchanger 10 can be suppressed from flowing, due to surface tension, onto the upper surface of flange portion (second flange portion) 214 from lower opening (first opening) 113 through between downwardly-extending wall portion 11*w* and circumferential wall portion (second circumferential wall portion) 211.

Furthermore, the gap between downwardly-extending wall portion 11*w* and circumferential wall portion (second circumferential wall portion) 211 is greater than the gap between downwardly-extending wall portion 11*w* and connection portion 215. Accordingly, drainage water produced inside sensible heat recovery heat exchanger 10 is likely to flow more into the gap between downwardly-extending wall portion 11*w* and connection portion 215 than into the gap between downwardly-extending wall portion 11*w* and circumferential wall portion (second circumferential wall portion) 211. Thus, drainage water can be suppressed from flowing through between downwardly-extending wall portion 11*w* and circumferential wall portion (second circumferential wall portion) 211. Thereby, the drainage water produced inside sensible heat recovery heat exchanger 10 can be suppressed from flowing onto the upper surface of flange portion (second flange portion) 214 through between downwardly-extending wall portion 11*w* and circumferential wall portion (second circumferential wall portion) 211.

Furthermore, connection portion 215 is inclined so as to be downwardly sloped toward the inside of circumferential wall portion (second circumferential wall portion) 211. Thereby, the drainage water produced inside sensible heat recovery heat exchanger 10 flows along the inner surface of connection portion 215 toward the inside of circumferential wall portion (second circumferential wall portion) 211. Thus, the drainage water can be suppressed from flowing toward flange portion (second flange portion) 214. Accordingly, the drainage water produced inside sensible heat recovery heat exchanger 10 can be suppressed from flowing onto the upper surface of flange portion (second flange portion) 214. Furthermore, when latent heat recovery heat exchanger 20 is entirely inclined to the outside of circumferential wall portion (second circumferential wall portion) 211, the drainage water adhering to connection portion 215 can be suppressed from flowing toward flange portion (second flange portion) 214.

As shown in FIG. 7, rising coupling portion 216 is joined from outside to the upper end of main body portion 218. Accordingly, rising coupling portion 216 can be readily welded to the upper end of main body portion 218.

Furthermore, first cutout portion 216*a* provided at the upper end of rising coupling portion 216 is arranged so as to overlap with second cutout portion 218*a* provided at the upper end of main body portion 218. Accordingly, drainage water can be caused to flow from first cutout portion 216*a* and second cutout portion 218*a* into through hole 217. Thereby, drainage water can be readily discharged.

Second Embodiment

Since the second embodiment of the present invention has the same configuration as that of the above-described first embodiment of the present invention unless otherwise specified, the same components are designated by the same reference characters, and the description thereof will not be repeated.

The above-described first embodiment has been explained with regard to the situation where sensible heat recovery heat exchanger 10 corresponds to a heat exchanger in the claims, and latent heat recovery heat exchanger 20 corresponds to a housing in the claims. In contrast, in the present embodiment, latent heat recovery heat exchanger 20 corresponds to a heat exchanger in the claims, and exhaust collection and guide member 70 corresponds to a housing in the claims.

Figure 10:
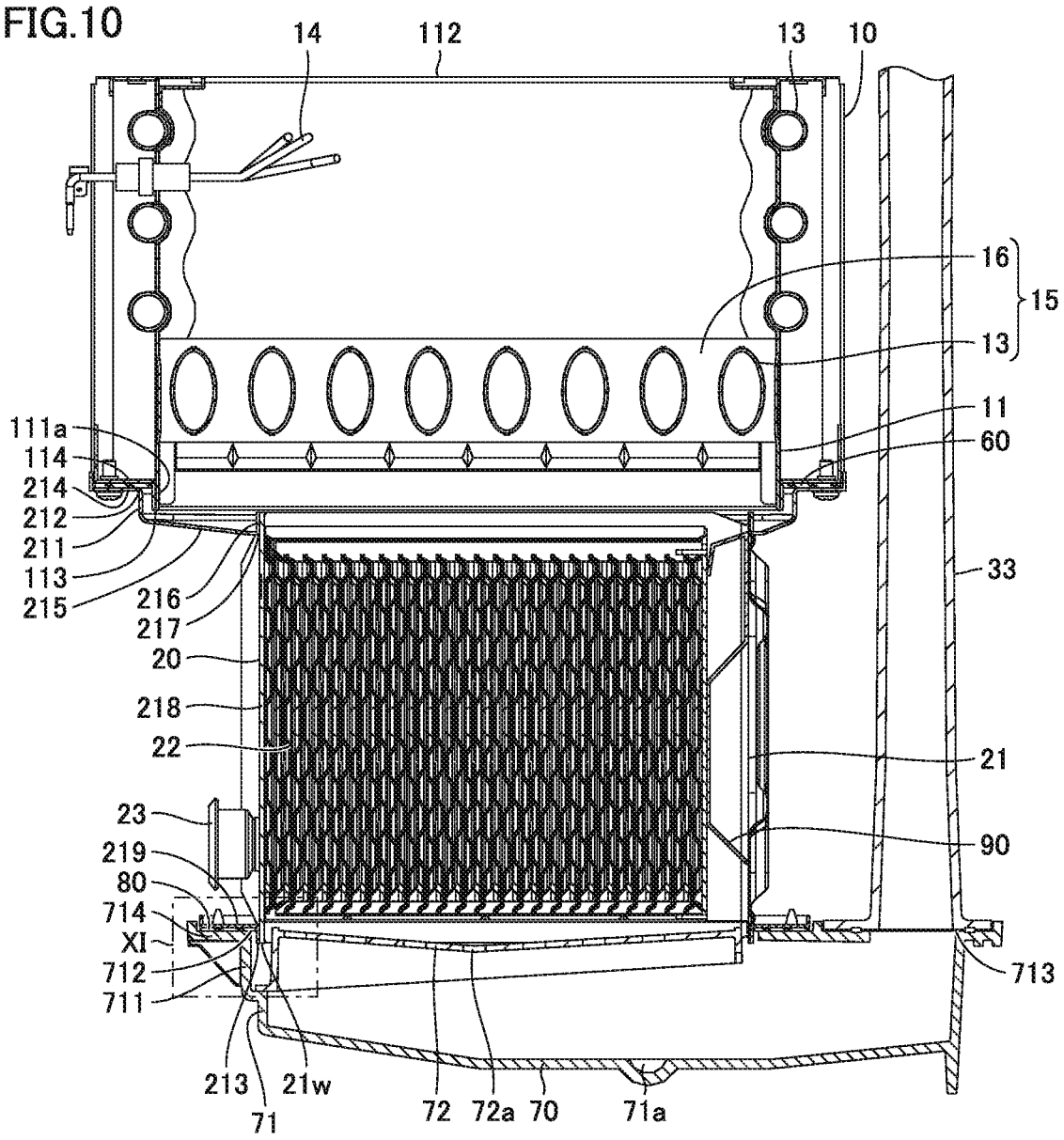
FIG. 10 is a cross-sectional view schematically showing the configurations of a sensible heat recovery heat exchanger, a latent heat recovery heat exchanger, an exhaust collection and guide member, and a duct in the second embodiment of the present invention.
Figure 11:
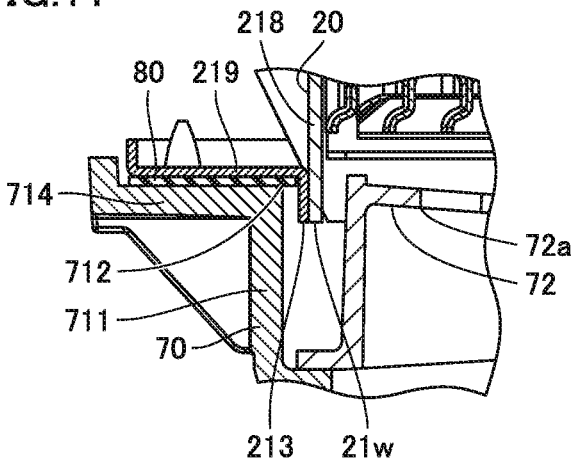
FIG. 11 is an enlarged view of a portion XI in FIG. 10.

As shown in FIGS. 10 and 11, latent heat recovery heat exchanger 20 is arranged on exhaust collection and guide member 70 with a sealing member 80 interposed therebetween. In other words, sealing member 80 is sandwiched between latent heat recovery heat exchanger 20 and exhaust collection and guide member 70. In addition, sealing member 80 does not have to be arranged between latent heat recovery heat exchanger 20 and exhaust collection and guide member 70.

Latent heat recovery heat exchanger 20 has a case (first case) 21 provided with a flange portion (first flange portion) 219. Flange portion 219 is located above lower opening (first opening) 213 and extends outward from main body portion (first circumferential wall portion) 218. Main body portion 218 has a downwardly-extending wall portion 21*w* arranged at the lower end of main body portion 218.

Exhaust collection and guide member 70 mainly has a case (second case) 71 and a partition plate 72. Case 71 is connected to case 21 of latent heat recovery heat exchanger 20. Case 71 has a circumferential wall portion (second circumferential wall portion) 711, an upper opening (second opening) 712, a connection opening 713, and a flange portion (second flange portion) 714.

Circumferential wall portion 711 of case 71 is arranged on the outside of downwardly-extending wall portion 21*w*. Combustion gas can be supplied to the inside of case 71 through upper opening 712 of case 71. Also, combustion gas can be emitted to duct 33 through connection opening 713 of case 71.

Flange portion 714 is arranged at the upper end of case 71. Flange portion 714 extends from circumferential wall portion 711 to the outside of case 71. Flange portion 714 is connected to the upper end of circumferential wall portion 711. Circumferential wall portion 711 is arranged on the inside of flange portion 714. Upper opening 712 is provided at the upper end of circumferential wall portion 711. Upper opening 712 is provided on the inside of circumferential wall portion 711. Connection opening 713 is connected to duct 33. Sealing member 80 is placed on flange portion 714.

Flange portion 714 of case 71 is connected to flange portion 214 of case 21 in latent heat recovery heat exchanger 20. Downwardly-extending wall portion 21*w* of case 21 is inserted into the inside of circumferential wall portion 711 through upper opening 712 of case 71. In the state where downwardly-extending wall portion 21*w* of case 21 is arranged on the inside of circumferential wall portion 711 of case 71, lower opening 213 of case 21 is located below the upper surface of flange portion 714 of case 71. In the present embodiment, lower opening 213 of case 21 is located below the lower surface of flange portion 714 of case 71.

Downwardly-extending wall portion 21*w* of case 21 is arranged such that a gap is interposed between downwardly-extending wall portion 21*w* and circumferential wall portion 711 of case 71. The gap between downwardly-extending wall portion 21*w* and circumferential wall portion 711 is provided on the outside of circumferential wall portion 711.

Case 71 houses a partition plate 72. Partition plate 72 is arranged below heat exchange portion 22. Partition plate 72 is provided with a plurality of holes 72*a*. Combustion gas having flown into exhaust collection and guide member 70 from latent heat recovery heat exchanger 20 flows through the plurality of holes 72*a* into duct 33. Furthermore, the drainage water having flown into exhaust collection and guide member 70 from latent heat recovery heat exchanger 20 is discharged through the plurality of holes 72*a* from an exhaust port 71*a* provided in the lower surface of case 71.

Then, the functions and effects of the present embodiment will be hereinafter described.

According to hot water apparatus 100 of the present embodiment, drainage water produced inside latent heat recovery heat exchanger 20 flows along the inner surface of downwardly-extending wall portion 21*w* downward from lower opening (first opening) 213. Accordingly, the drainage water can be suppressed from flowing onto the upper surface of flange portion (second flange portion) 714 located above lower opening (first opening) 213. Thereby, the drainage water produced inside latent heat recovery heat exchanger 20 can be suppressed from flowing through between the lower surface of flange portion (first flange portion) 214 and the upper surface of flange portion (second flange portion) 714.

Furthermore, lower opening (first opening) 213 is located below the lower surface of flange portion (second flange portion) 714. Accordingly, the distance from lower opening (first opening) 213 to the upper surface of flange portion (second flange portion) 714 in the vertical direction is greater than the distance from the upper surface of flange portion (second flange portion) 714 to the lower surface thereof in the vertical direction. Thus, the drainage water produced inside latent heat recovery heat exchanger 20 can be effectively suppressed from flowing through lower opening (first opening) 213 onto the upper surface of flange portion (second flange portion) 714.

Furthermore, downwardly-extending wall portion 21*w* is arranged such that a gap is interposed between downwardly-extending wall portion 21*w* and circumferential wall portion (second circumferential wall portion) 711. Accordingly, the drainage water produced inside latent heat recovery heat exchanger 20 can be suppressed from flowing, due to surface tension, from lower opening (first opening) 213 through between downwardly-extending wall portion 21*w* and circumferential wall portion (second circumferential wall portion) 711 onto the upper surface of flange portion (second flange portion) 714.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. A hot water apparatus comprising:

a heat exchanger including a heat exchange portion and a first case in which the heat exchange portion is housed; and a housing including a second case connected to the first case of the heat exchanger, the first case of the heat exchanger including a first circumferential wall portion, a first opening provided at a lower end of the first circumferential wall portion, and a first flange portion located above the first opening and extending outward from the first circumferential wall portion, the second case of the housing including a second flange portion connected to the first flange portion, a second circumferential wall portion arranged inside the second flange portion, and a second opening provided at an upper end of the second circumferential wall portion, the first circumferential wall portion of the heat exchanger including a downwardly-extending wall portion that is inserted through the second opening of the housing into an inside of the second circumferential wall portion, in a state where the downwardly-extending wall portion is arranged inside the second circumferential wall portion, the first opening being located below an upper surface of the second flange portion, wherein the downwardly-extending wall portion is arranged such that a gap is interposed between the downwardly-extending wall portion and the second circumferential wall portion, the housing includes a connection portion connected to a lower end of the second circumferential wall portion, the connection portion extends toward an inside of the second circumferential wall portion, and is arranged such that a gap is interposed between the connection portion and a lower end of the downwardly-extending wall portion, and the gap between the downwardly-extending wall portion and the second circumferential wall portion is greater than the gap between the downwardly-extending wall portion and the connection portion.

2. The hot water apparatus according to claim 1, wherein the first opening is located below a lower surface of the second flange portion.

3. The hot water apparatus according to claim 1, wherein the downwardly-extending wall portion is provided on an entire circumference of the first circumferential wall portion.

4. The hot water apparatus according to claim 1, wherein the first circumferential wall portion includes a plate member, and the downwardly-extending wall portion is formed by folding the plate member at the lower end of the first circumferential wall portion.

5. The hot water apparatus according to claim 1, wherein the connection portion is inclined so as to be downwardly sloped toward the inside of the second circumferential wall portion, and is arranged such that a gap is interposed between the connection portion and a lower end of the downwardly-extending wall portion.

6. The hot water apparatus according to claim 1, wherein the housing includes a rising coupling portion arranged inside the connection portion and rising upward from the connection portion, a through hole surrounded by the rising coupling portion, and a main body portion inserted into the through hole, and the rising coupling portion is joined from outside to an upper end of the main body portion.

7. The hot water apparatus according to claim 6, wherein the rising coupling portion includes a first cutout portion provided at an upper end of the rising coupling portion, the main body portion includes a second cutout portion provided at the upper end of the main body portion, and the first cutout portion is arranged so as to overlap with the second cutout portion.

* * * * *